US005094161A

United States Patent [19]

Taylor

[11] Patent Number: 5,094,161

[45] Date of Patent: Mar. 10, 1992

[54] COUNTER TOP MULTI-COLOR SINGLE STATION PRINTING METHOD AND APPARATUS

[76] Inventor: Richard E. Taylor, 97 Goldflake Ter., Breckenridge, Colo. 80424

[21] Appl. No.: 503,665

[22] Filed: Apr. 3, 1990

[51] Int. Cl.[5] ..... B41M 1/12

[52] U.S. Cl. ..... 101/129; 101/115; 101/126

[58] Field of Search ..... 101/114, 115, 123, 124, 101/126, 129, 127.1

[56] References Cited

U.S. PATENT DOCUMENTS

| | | | |
|---|---|---|---|
| 1,029,544 | 6/1912 | Horvath | 101/115 |
| 1,328,368 | 1/1920 | Cotoli | 101/115 |
| 1,518,863 | 12/1924 | Lutz et al. | 101/115 |
| 2,244,272 | 6/1941 | Vollstorf | 101/115 |
| 3,460,470 | 8/1969 | Green et al. | 101/115 |
| 3,460,471 | 8/1969 | Green et al. | 101/115 |
| 4,084,504 | 4/1978 | Fuchs | 101/115 |
| 4,315,461 | 2/1982 | Harpold | 101/115 |
| 4,388,862 | 6/1983 | Thomas et al. | 101/126 |
| 4,509,420 | 4/1985 | Stroffolino | 101/126 |
| 4,606,268 | 8/1986 | Jaffa | 101/115 |
| 4,679,501 | 7/1987 | Hanosh | 101/114 |
| 4,708,057 | 11/1987 | Hogenson | 101/129 |
| 4,809,604 | 3/1989 | Harpold | 101/115 |
| 4,813,351 | 3/1989 | Pierson | 101/115 |
| 4,852,483 | 8/1989 | Bussard | 101/128 |
| 4,869,165 | 9/1989 | Louiche | 101/128.4 |

OTHER PUBLICATIONS

*Hix Direct*, "The Hix Rotary Printer and Its Pin Registration System", Oct. 1988 (pp. 6 & 7).

*Primary Examiner*—Edgar S. Burr
*Assistant Examiner*—Christopher A. Bennett
*Attorney, Agent, or Firm*—John E. Reilly

[57] ABSTRACT

A multi-color printing apparatus is specifically adapted for printing designs on clothing by the application of ink to successive silk screens, the apparatus including a pedestal having registration pins for insertion in openings in the silk screen supporting frame, and a clamping plate is hingedly mounted above the supporting frame with a lever arm to force the clamping plate downwardly against the support frame into complete registry with the pins. Lift tabs are also provided to lift the supporting frame away from pins after completion of each printing stage, and a printboard is adjustably mounted on a pivot arm to align the article of clothing with respect to the silk screen.

13 Claims, 3 Drawing Sheets

COUNTER TOP MULTI-COLOR SINGLE STATION PRINTING METHOD AND APPARATUS

This invention relates to a method and apparatus for printing designs on various items; and more particularly relates to a novel and improved method and apparatus for multi-color printing of designs on items, such as, articles of clothing in a reliable and highly efficient manner.

BACKGROUND AND FIELD OF INVENTION

There is a proliferation of T-shirt shops in this country and characteristically these shops specialize in custom work where a customer will make a specific request for a certain shirt design. It is virtually impossible for the small shops to carry a complete line of shirt designs and accordingly when a customer requests a particular shirt design, rather than to carry all of the shirts in stock, it is desirable to be able to imprint the design on the shirt while the customer waits. More and more, shirt designs are multi-colored but the silk screen equipment designed for such multi-color jobs is quite expensive and beyond the means and budget of most of the smaller shirt shops to carry such equipment and to be able to furnish custom printing services on site. Moreover, the multi-color printing systems now in use are quite bulky and occupy a fair amount of space so as not to be very practical for use in the smaller shops.

A particular problem associated with multi-color printing with silk screens is that the screens cannot be aligned accurately enough to permit successive placement of different screens over the same shirt or other article to perform multi-color jobs. In other words, unless each screen is accurately positioned and aligned with respect to the shirt and the preceding application of one color to the shirt, the different colored inks will tend to bleed or run together.

Of the various efforts made to solve this problem, U.S. Pat. No. 4,708,057 to T. C. Hogenson proposes to employ hinged brackets which clampingly engage a silk screen but is primarily concerned with multi-color wrap-around designs. In order to avoid the problem of accurate realignment between the different color patterns applied in succession to the article, Hogenson employs a printing platen having light-transmitting sections located in those areas where the edges of the article needing alignment will rest on the platen so that by directing light through those sections the operator can more accurately align and register the successive patterns applied.

U.S. Pat. No. 4,679,501 to A. L. Hanosh is also concerned with the problem of registration or proper alignment of the garment with respect to indicia to be printed on the garment, but Hanosh is concerned more with the proper positioning of a transparent sheet with respect to a silk screen.

U.S. Pat. Nos. 3,460,470 and 3,460,471 to M. E. Green et al disclose a method and apparatus for multicolor silk screen printing in which front and side guide pins are provided to establish proper registration of the article. U.S. Pat. No. 4,606,268 to D. Jaffa is directed to a multistation printing device similar to that of Hogenson; and U.S. Pat. No. 4,315,461 to C. W. Harpold uses the combination of hinged clamps and a counterweight to retain the screen in a particular position for multicolor printing. Also, Harpold provides for adjustable positioning of the distance between the print head and platen. Other representative patents are U.S. Pat. Nos. 1,029,544 to G. Horvath; 1,518,863 to A. H. Lutz et al and 2,244,272 to K. B. Vollstorf.

SUMMARY OF INVENTION

It is therefore an object of the present invention to provide for a novel and improved method and apparatus for multi-color printing of designs or wording, on an article and which is specifically adapted for use in silk screen printing of multi-color designs on articles of clothing, such as, T-shirts.

It is another object of the present invention to provide for a novel and improved apparatus for multi-color printing of designs on an article which is simplified, low-cost and occupies a minimum of space.

A further object of the present invention is to provide an apparatus for silk screen, multi-color printing for accurate registry of different portions of a design which requires successive applications of different colored inks.

It is an additional object of the present invention to provide apparatus for silk screen printing articles of clothing which is versatile and readily conformable for use in printing two or more different designs in succession on articles of clothing.

An additional object of the present invention is to provide for a novel and improved method and apparatus for multi-color, single station printing of designs on articles which is portable, extremely compact and are both time and labor saving in use.

In accordance with the present invention, a novel and improved apparatus has been devised for imprinting multi-color designs on articles and particularly articles of clothing which comprises support means for supporting the article to be printed on a flat support surface, a support frame for a silk screen including positioning means for mounting the support frame above the article to be printed. The frame includes spaced registration pins insertable in openings in the support frame, the pins disposed at right angles to a plane passing through the silk screen, and retainer means are provided for urging the support frame against the article to be printed when ink is applied to the silk screen onto the article. Preferably, the retainer means is a hinged member which is positioned adjacent to the registration pin and when the pins are inserted into the frame the plate member is swung downwardly to force the frame against the article to be printed, and lift tab means are provided in association with the plate member to engage the underside of the frame upon completion of each printing step to lift the frame away from the registration pins. The article support means is preferably mounted on a pivotal arm which upon completion of each printing step or at the end of an entire printing operation can be swung into alignment with a dryer.

The method of aligning and printing multi-colored designs on articles in accordance with the present invention comprises the steps of positioning a portion of the article to be printed on a flat support surface, mounting a support frame containing a silk screen over the article and positioning the frame on registration pins in fixed relation to the article when ink is supplied to the silk screen to form one color of the design, lifting the first silk screen away from the article, drying the ink, and repeating the steps of mounting a support frame containing a second silk screen over the article, positioning in fixed relation to the article and applying a second color of the design to the article.

The above and other objects, advantages and features of the present invention will become more readily appreciated from a consideration of the following detailed description of a preferred embodiment thereof, when taken together with the accompanying drawings, in which:

DETAILED DESCRIPTION OF THE PREFERRED EMBODIMENT

Figure 1:
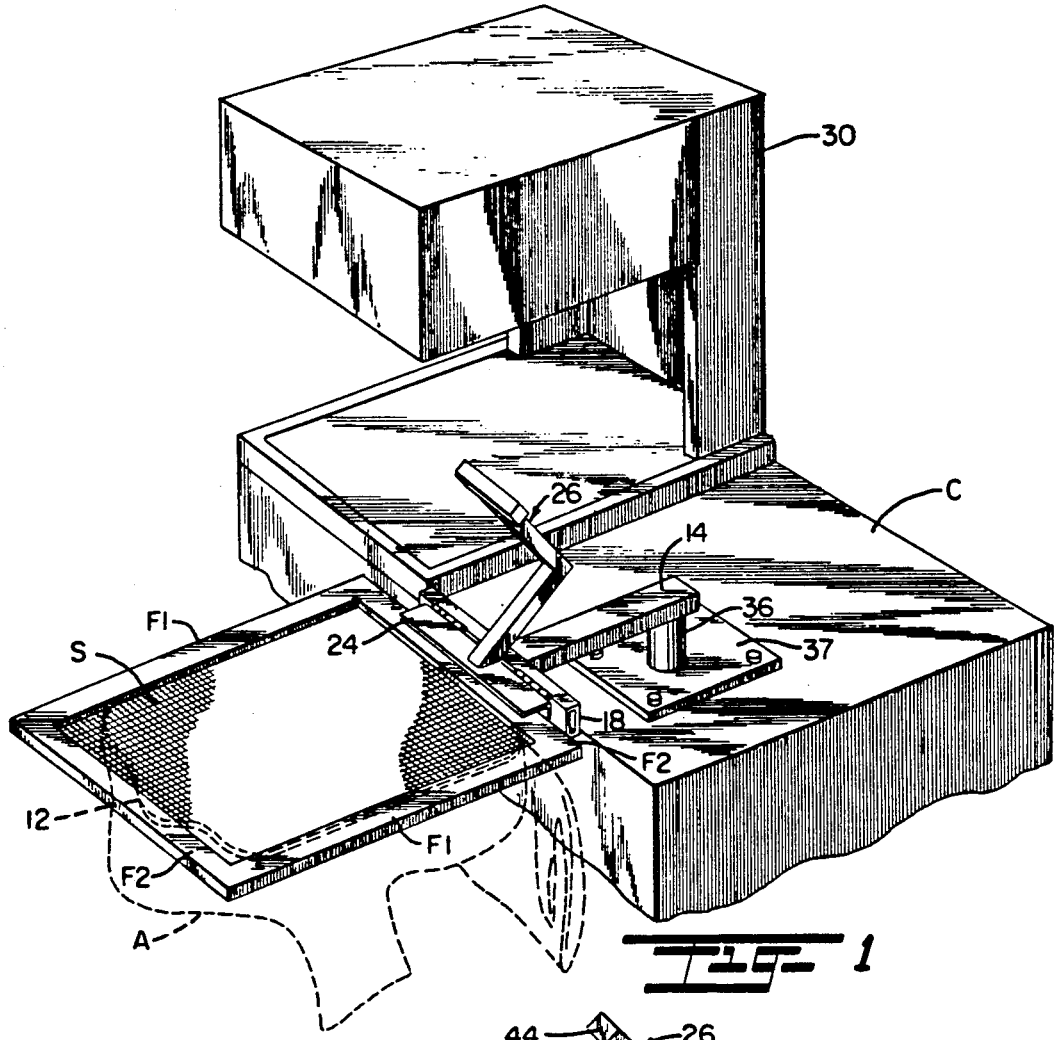
FIG. 1 is a perspective view of a preferred form of silk screen printing apparatus in accordance with the present invention.

Referring in more detail to the drawings, there is shown by way of illustrative example in FIG. 1 a preferred form of printing apparatus used in printing multicolor designs and/or wording onto T-shirts as represented at A. The apparatus is broadly comprised of a flat support surface in the form of a print board 12 attached by pivot arm 14 to a table or countertop as generally designated at C. A conventional form of silk screen S is mounted in a support frame F having opposite sides F1 and ends F2 with a pair of spaced openings 10 at one end F2 which extend through the thickness of the frame on axes perpendicular to the plane of the frame.

An anchor bar 18 is fixed to the pivot arm 14 and extends normal to the length of the arm, and a pedestal or pin support member 20 includes a pair of spaced, upright pins 22 which are dimensioned for extension in close-fitting engagement through the openings 10. A clamping plate 24 is hinged to the bar 18, a lever arm 26 extending upwardly from the plate 24, and lift tabs 28 depend downwardly from the plate 24 at locations outboard of the two pins 22. Although forming no part of the printing apparatus per se, a dryer 30 is disposed on the table or countertop C in a position alongside of the apparatus as described and the board 12 is free to move or pivot horizontally into the dryer section for the purpose of accelerated drying of the ink on the T-shirt.

In the preferred form, the print board 12 is a flat generally rectangular member having a curved or rounded outer end 32 to facilitate slipping of the T-shirt with the side to be imprinted over the board. The board 12 is adjustably connected to pivot arm 14 by a generally channel-shaped bracket 33, and set screws 34 permit adjustment of the board toward and away from the pedestal 20.

The pivot arm 14 preferably is of tubular construction and of a generally rectangular cross-section and includes a pivot shaft 35 at one end to fit into an upright socket 36, the latter having a base plate 37 secured by bolts 38 to the countertop C.

The anchor bar 18 similarly is of tubular construction and of generally rectangular cross-section with its greater dimension disposed in a vertical direction and welded to the pivot arm 14 relatively near the pivotal end 35 and away from the opposite free end of the arm.

The pedestal 20 is of tubular construction having a generally rectangular cross-section and is welded to the arm 14 directly in front of and abutting the bar 18, the upper surface of the pedestal being flush with the upper surface of the board 12. The pins 22 are spaced away from the bar 18 and have a height less than the thickness of the screen S with a diameter equal to the diameter of the opening 10 for close-fitting engagement therewith.

Figure 2:
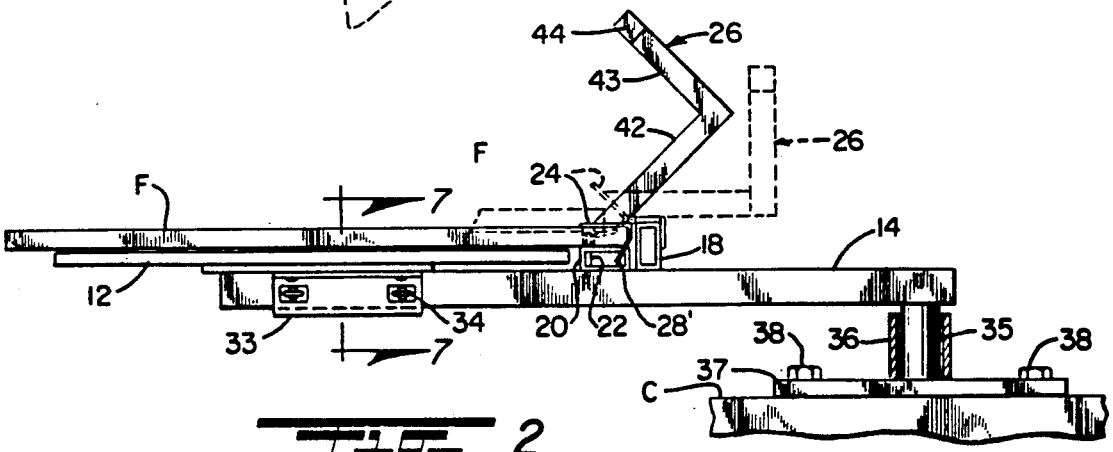
FIG. 2 is a side view in elevation of the preferred form and with parts illustrated in section.
Figure 3:
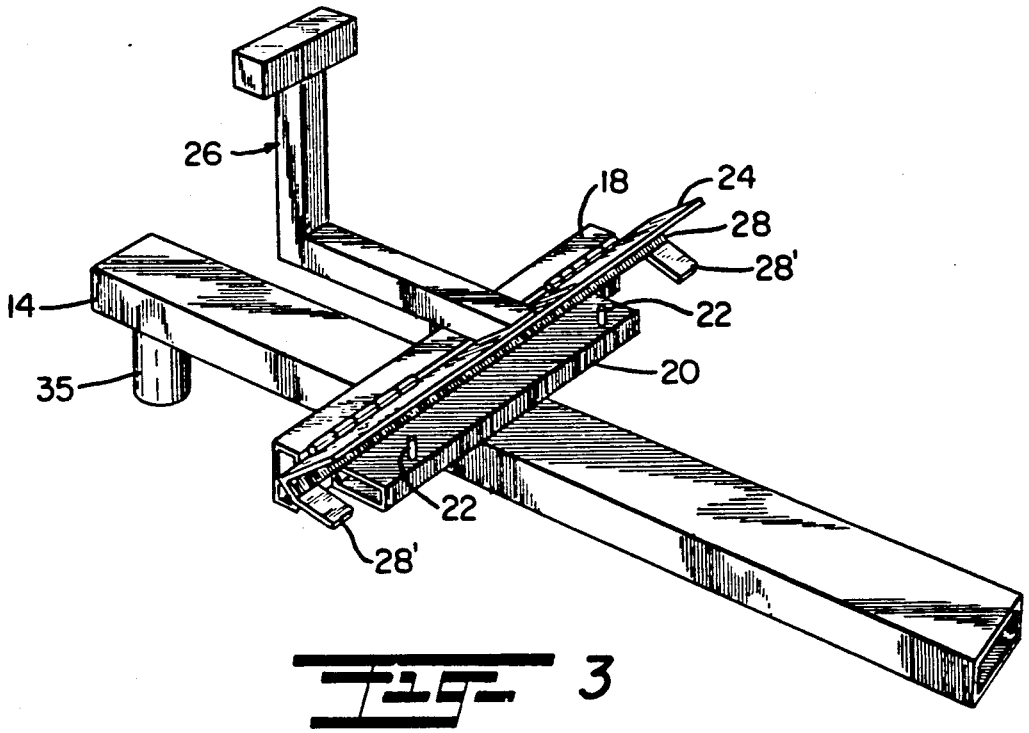
FIG. 3 is a perspective view of the silk screen holder of the preferred form of invention with a clamping member illustrated in a raised position.
Figure 4:
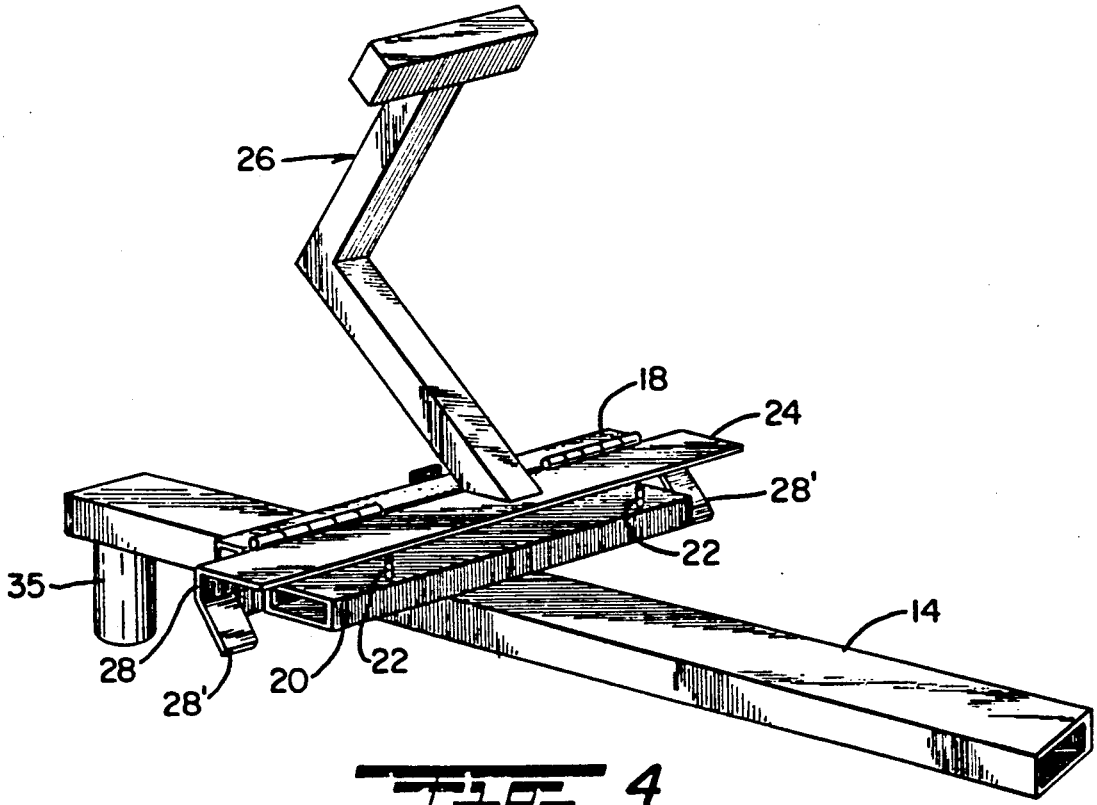
FIG. 4 is another perspective view of the holder shown in FIG. 3 but with the clamping member illustrated in a lowered position.
Figure 6:
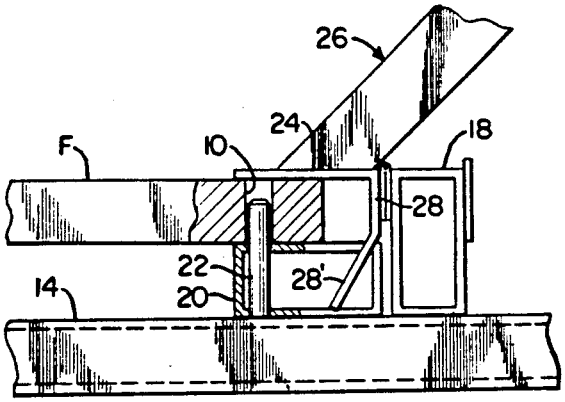
FIG. 6 is a side view partially in section of the holder illustrated in FIGS. 3 and 4 and with a silk screen mounted in the holder.
Figure 5:
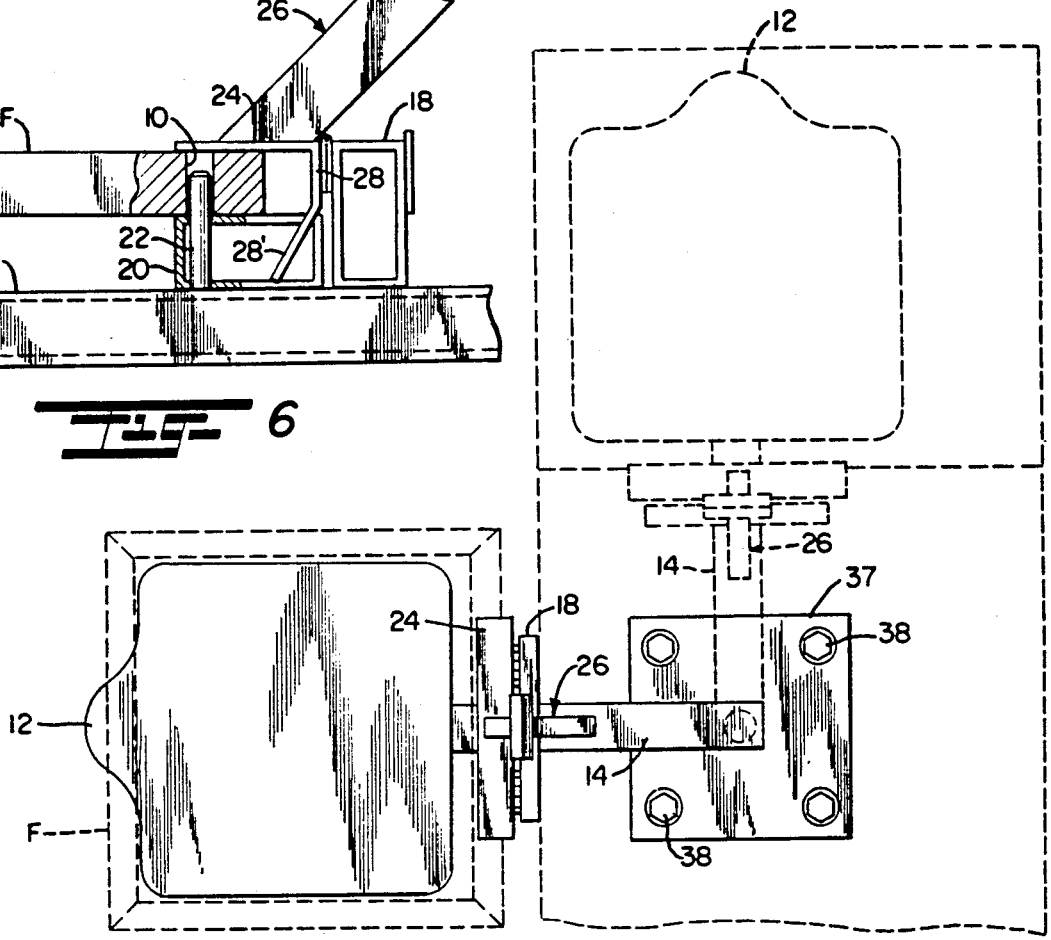
FIG. 5 is a top plan view of the preferred form of printing apparatus.
Figure 7:
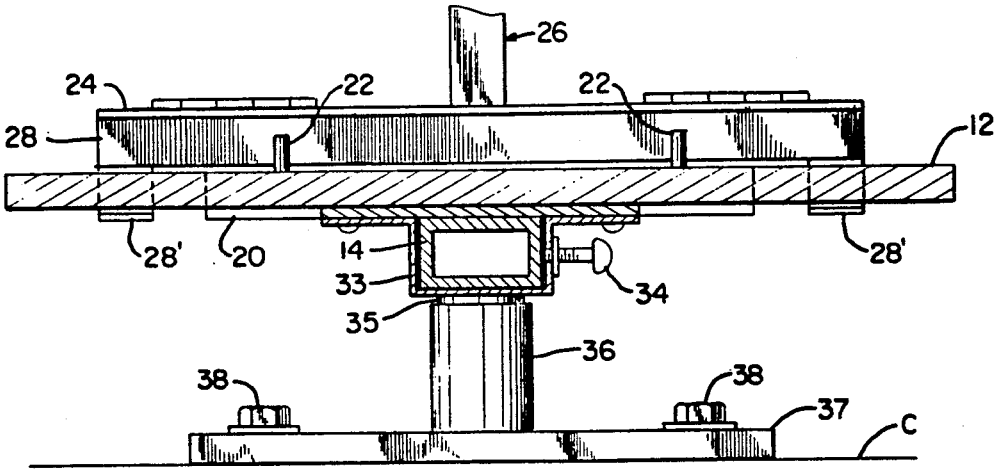
FIG. 7 is a front view partially in section of the preferred form of printing apparatus.

The clamping plate 24 is hinged at 40 to the upper corner of the bar 18 and, as shown in FIG. 2, is moved between a horizontal position bearing against the upper surface of the end of the frame of the silk screen S and a raised position. The lift tabs 28 extend downwardly substantially at right angles to the plate 24 with lower free ends 28 angling forwardly from the upper section of the plate 24 and are spaced slightly outboard of the opposite ends of the pedestal 20. The lever arm 26 is preferably comprised of right angle sections 42 and 43 and a handle 44 at the upper free end of section 43. The lowered position of the clamping plate is illustrated in full in FIG. 2 and, when the lever arm 26 is swung or advanced into the dotted line position as illustrated in FIG. 2, the lift tabs 28 are raised into engagement with the underside of the silk ccreen frame and under continuing pressure will lift the frame away from engagement with the pins 22.

In use, the front or back of the T-shirt A to which the design is to be applied is placed on top of the support surface of the print board 12. The lever arm 26 is lifted and the screen S positioned such that its openings 10 are aligned with the pins 22 and the end F2 of the frame bears against the lift tabs 28. The lever arm 26 is then moved forwardly to cause the plate 24 to bear down on the frame and cause the pins 22 to be fully inserted into the openings 10. Care should be taken to insure that the shirt is properly centered beneath the frame F, and if necessary the bracket screws 34 can be loosened and the board 12 longitudinally adjusted with respect to the frame to establish the desired alignment.

The ink is applied in a conventional manner across the silk screen and, although not necessary in all cases, pressure can be exerted on the clamping plate to force the frame down firmly against the article during the silk screening operation. In a multi-color printing operation, the ink of one color is first applied with the screen forming the desired image or design on the shirt in that color. The screen is removed by raising the plate 24 with the lift tabs moving upwardly into engagement with the frame to release it from the pins 22. The screen is then lifted off of the pedestal 20 and the shirt pivoted with the print board 12 under the dryer 30 to accelerate the drying process. Once dry, the shirt which is left intact on the print board is returned to its initial position and a second silk screen positioned on the pins and clamped down in the manner described with respect to the first screen.

When the second screen is positioned on the pins 22, accurate realignment is assured by the positive positioning of the pins 22 with respect to the openings so that when the second color ink is applied it will not tend to run over or bleed into the first color. After the second inking operation, the second screen is removed and, if additional colors are to be added, the process is repeated for each color. Assuming that the design is a two-color design, after removal of the second screen the shirt is then once again dried and removed from the print board.

Many inks do not require drying between successive inking applications of each color but may simply wait until all colors have been applied and then the shirt dried as the final step in the operation. The dryer 30 may be any one of a number of commercially available dryers, such as, the dryer system sold under the trademark "BLACK BODY" by DBC Industries, Inc., of Fulton, Mo.

Although a preferred form of printing apparatus has been described specifically in relation to the application of multi-color designs for T-shirts, it will be evident that the apparatus has useful application to other articles of clothing as well as virtually any article to which a silk screen image can be applied. Moreover, while the dryer section is illustrated as being located alongside the pivot end of the printing apparatus, various forms of dryers may be employed, such as, of the portable variety which can be used for drying between ink applying stages without necessity of pivoting the print board each time.

Accordingly, it is to be understood that while a preferred form of invention has been set forth and described herein, various modifications and changes may be made without departing from the spirit and scope thereof as defined by the appended claims.

I claim:

1. Apparatus for multi-stage printing of designs on an article comprising:

means for supporting said article on a flat supporting surface;

a support frame for a silk screen, said frame provided with spaced openings therein and positioning means for mounting a silk screen above said article, said positioning means including spaced registration pins insertable into said openings in said support frame, said pins disposed at right angles to a plane substantially parallel with and passing through said support frame; and retainer means for clampingly engaging said support frame and cooperating with said registration pins to retain said support frame in fixed relation to said article when ink is applied to said silk screen for imprinting on said article.

2. Apparatus according to claim 1, said retainer means clampingly engaging an end of said support frame whereby to force said support frame downwardly against said article.

3. Apparatus according to claim 1, said registration pins dimensioned for close-fitting engagement in the openings in said support frame, and release means movable into engagement with said support frame to dislodge said support frame from said pins.

4. Apparatus according to claim 1, including means for mounting said article supporting means for pivotal movement in a plane parallel to the plane of said support frame.

5. Apparatus according to claim 1, said article supporting means including means for adjustably positioning said article in alignment with said support frame.

6. Apparatus according to claim 1, said retainer means including a retainer plate mounted in hinged relation to said positioning means, a lever arm, and lift tab means extending from said retainer plate for engagement with said support frame when said retainer plate is raised by said lever arm member away from clamping engagement with said support frame.

7. In apparatus for multi-color printing of designs on an article of clothing wherein means are provided for supporting said article on a flat supporting surface, said improvement comprising:

a support frame for a silk screen, said support frame provided with spaced openings at one end thereof including positioning means for mounting a silk screen over said article, said positioning means including spaced registration pins insertable into said openings at one end of said support frame, said pins disposed at right angles to a plane passing through said support frame;

retainer means cooperating with said registration pins to retain said support frame in fixed relation to said article when ink is applied to said silk screen for imprinting on said article, said retainer means clampingly engaging an end of said support frame whereby to force said support frame downwardly against said article; and said retainer means including a retainer plate mounted in hinged relation to said positioning means, a lever arm, and a pair of lift tabs extending from said retainer plate for engagement beneath said support frame when said retainer plate is raised by said lever arm member away from clamping engagement with said support frame.

8. In apparatus according to claim 7, said registration pins dimensioned for close-fitting engagement in the openings in said support frame including release means movable into engagement with said support frame to dislodge said support frame from said pins.

9. In apparatus according to claim 7, including means for mounting said article supporting means for pivotal movement in a plane parallel to the plane of said support frame, and a dryer member in the path of movement of said article supporting means.

10. In apparatus according to claim 7, said article support means including means for adjustably positioning said article in alignment with said support frame.

11. The method of aligning and printing multi-colored designs on an article comprising the steps of:

(a) positioning a portion of said article to be printed in a first position on a flat support surface;

(b) mounting a silk screen and support frame over said article and positioning said first support frame on registration pins in fixed relation to said article when ink of one color is applied to said silk screen;

(c) lifting said first silk screen and support frame away from said article;

(d) mounting a second support frame containing a silk screen over the article and positioning the support frame on registration pins in fixed relation to the article whereby ink of another color is applied to the second silk screen;

(e) lifting the second silk screen and support frame away from the article; and (f) followed by drying the ink applied to the article.

12. The method according to claim 11 further characterized by clamping said support frames in position over said article preliminary to application of ink of each color to said first and second silk screens.

13. The method according to claim 11, including the steps of pivoting the article to a second position and drying after each application of ink.

* * * * *